US007033006B2

(12) United States Patent
Ebisawa et al.

(10) Patent No.: US 7,033,006 B2
(45) Date of Patent: Apr. 25, 2006

(54) INK JET RECORDING DEVICE AND INK SUPPLYING METHOD IN THE DEVICE

(75) Inventors: Isao Ebisawa, Tokyo (JP); Toshimitsu Danzuka, Kanagawa (JP); Yoshito Mizoguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 10/757,562

(22) Filed: Jan. 15, 2004

(65) Prior Publication Data

US 2004/0145635 A1 Jul. 29, 2004

(30) Foreign Application Priority Data

Jan. 17, 2003 (JP) ..... 2003-009070
Dec. 10, 2003 (JP) ..... 2003-411795

(51) Int. Cl.
*B41J 2/175* (2006.01)

(52) U.S. Cl. ..... 347/85
(58) Field of Classification Search ..... 347/85
See application file for complete search history.

(56) References Cited

U.S. PATENT DOCUMENTS

| | | | | |
|---|---|---|---|---|
| 4,631,556 | A * | 12/1986 | Watanabe et al. | 347/30 |
| 4,775,871 | A | 10/1988 | Abe et al. | 347/85 |
| 4,926,196 | A | 5/1990 | Mizoguchi et al. | 347/23 |
| 5,289,207 | A | 2/1994 | Ebisawa | 347/23 |
| 5,428,380 | A | 6/1995 | Ebisawa | 347/35 |
| 5,748,207 | A | 5/1998 | Inui et al. | 347/43 |
| 6,540,321 | B1 | 4/2003 | Hirano et al. | 347/22 |
| 2003/0227496 | A1 | 12/2003 | Ebisawa | 347/7 |

FOREIGN PATENT DOCUMENTS

JP 2000-334982 12/2000

* cited by examiner

*Primary Examiner*—K. Feggins
*Assistant Examiner*—Rene Garcia, Jr
(74) *Attorney, Agent, or Firm*—Fitzpatrick, Cella, Harper & Scinto

(57) ABSTRACT

A stable image may not be obtained due to condensation of an ink left in a subtank. According to the present invention, a stable image is always obtained by changing a method for supplying an ink from a main tank to the subtank in accordance with an elapsed time from the end of previous printing.

9 Claims, 14 Drawing Sheets

INK JET RECORDING DEVICE AND INK SUPPLYING METHOD IN THE DEVICE

BACKGROUND OF THE INVENTION

1. Field of the Invention

The present invention relates to an ink jet recording device and an ink supplying method in the device, and a main object of the invention is to stabilize color reproducibility of an output image.

2. Description of the Related Art

As a conventional ink jet recording device, there is a device of a so-called serial scanning system in which a recording head as recording means and an ink tank as an ink container are exchangeably mounted on a carriage movable in a main scanning direction. In this recording system, images are sequentially recorded on a recording medium by repeating the main scanning of the carriage on which the recording head and the ink tank are mounted, and the sub-scanning (conveying) of the recording medium.

If consideration is given to realization of a microprinter suited for personal digital assistants (PDA), cameras or the like by using such serial scanning recording system, an ink volume of the ink tank mounted on the carriage must be set extremely small since a size of the carriage itself becomes small. However, if a capacity of the ink tank on the carriage is extremely small, there is a possibility that replacement of the ink tank will become frequent or the ink tank will have to be replaced during a recording operation.

Thus, in order to solve such a problem, Japanese Patent Application Laid-Open No. 2000-334982 presents a device of an ink supplying system (referred to as a pit-in ink supplying system for convenience hereinafter) which replenishes an ink tank (referred to as a subtank hereinafter) on a carriage with an ink from an ink containing member (referred to as a main tank hereinafter: the main tank is generally much larger than the ink tank on the carriage) disposed separately from the carriage at proper timing each time the carriage is moved to a predetermined standby position.

According to the disclosed device, for example, for each printing on one recording medium, the carriage is moved to the predetermined standby position to connect the subtank on the carriage with the main tank by a joint member at proper timing, and the subtank is replenished with the ink from the main tank in the connected state. Thus, it is possible to solve the aforementioned problem caused by the extremely small ink volume of the subtank on the carriage.

SUMMARY OF THE INVENTION

Regarding the foregoing constitution, the inventors, et al. have conducted wholehearted studies to discover the following. That is, if the ink jet recording device is left unused for a relatively long time, and printing is tried again, a color tone of an image becomes unnatural, or color tones become different among a plurality of images if the same image is continuously printed.

Such an unnatural color tone or color variance of the same print is a particularly unfavorable phenomenon for a camera printer to print photos.

Such a phenomenon is caused by condensation of the ink in the subtank which occurs when the printer is left in a low-humidity environment for a long time. This problem can be mitigated by disposing a mechanism to close an opening of the subtank when necessary, making the subtank of a material of small gas permeability, or increasing a thickness of the tank.

However, the foregoing provides no fundamental measures unless evaporation becomes zero. Additionally, such measures increase costs, and an increased size of the subtank portion impedes miniaturization of the recording device.

The inventors have conducted more specific studies to discover that if the ink jet recording device is left unused for a relatively long time, viscosity of the ink in the subtank is greatly increased to be much higher than ink viscosity used in a general ink jet printer, and consequently nozzle recovery of the recording head is impossible.

FIG. 12 is conceptual diagrams time-sequentially explaining a relation between the subtank and the amount of a residual ink in the subtank. (a) in FIG. 12 shows a state in which the subtank is filled with the ink by the pit-in ink supplying system. After the end of printing, a state is set in which the ink used for the printing has been consumed as shown in (b) in FIG. 12. Incidentally, if the pit-in ink supplying system is applied to a compact printer, a capacity of the subtank is extremely small and, for example, the amount of a contained ink for each color is 0.4 ml (=400 μl). In (a) in FIG. 12, the subtank is filled with the ink of 0.4 ml. In (b) in FIG. 12, a half of the ink, i.e., 0.2 ml, is consumed while 0.2 ml is left.

If the printer is left in the state of (b) in FIG. 12, an evaporable component such as moisture of the ink is evaporated from the subtank. A speed of the evaporation varies depending on a material or a thickness of the subtank, a material or a constitution of a cap to prevent drying of the nozzle of the recording head, or the like. In any case, the evaporation progresses at a given speed. For example, if an evaporation speed is 0.002 ml per day (=2 μl/day) for each color, about 100 μl is evaporated in 50 days, and an evaporation rate from an initial weight becomes 50%. If the printer is left more, the evaporation speed becomes slightly slow, but a state is reached at the end in which all evaporable solvent components in the ink are completely evaporated (state of (c) in FIG. 12). Incidentally, the evaporation speed is a speed in a driest state in an operation guarantee environment of the printer. (d) in FIG. 12 shows a state after the pit-in.

As an ink composition used in the general ink jet recording device, a color material component of a nonvolatile dye or pigment is 10% or lower, a solvent ratio of a low-volatility solvent (e.g., glycerin or ethylene glycol) is about 15% to 40%, and the remaining is volatile water or alcohol. The low-volatility solvent is evaporated little by little to be exact. However, since volatility is absolutely lower compared with water or the like, the color material and the low-volatility solvent are referred to as nonvolatile solvents for convenience, and a ratio thereof is tentatively set to 25%. Then, in the above example, ink residual amount 200 μl×volatile component ratio 0.75=150 μl can be evaporated, and evaporable water etc., are all evaporated in about 75 days. This point is referred to as an evaporation limit (actually, other low-volatility solvents are gradually evaporated thereafter).

Volatility of such an ink is, though dependent on a composition, about 2.0 mPa·s at the time of no evaporation, and 10.0 mPa·s at the time of 50% evaporation in the case of an ink of a sixth embodiment of the present invention (described later). On the other hand, viscosity of an ink evaporated to the evaporation limit of 75% reaches about 400 mPa·s which is higher by 200 times or more than general ink viscosity at the time of no evaporation.

If there is such a high-viscosity ink in the nozzle, the ink cannot be pulled by a suction recovery method of the conventional ink jet recording device, and this nozzle becomes a jet failure nozzle. Incidentally, such a phenomenon is a problem unique to the pit-in ink supplying system which uses a small-capacity subtank and in which a degree of ink concentration is easily increased by leaving the subtank while a small amount of ink remains in the subtank.

The present invention has been made in view of the foregoing situations, and an object of the invention is to mitigate adverse effects of ink condensation in the subtank generated in the pit-in ink supplying system which uses the small-capacity subtank.

Another object of the present invention is, even if ink condensation occurs, to reduce unnaturalness of a color tone of an image which is one of the adverse effects of the ink condensation.

Still another object of the present invention is, even if ink condensation occurs, to reduce a difference in color tone among a plurality of images which is one of the adverse effects of the ink condensation.

A further object of the present invention is to prevent occurrence of nozzle jet failures, thereby enabling good images to be obtained even if a subtank is left for a long time.

A further object of the present invention is to improve color reproducibility even if ink condensation occurs.

A first aspect of the present invention is directed to an ink jet recording device which has a first ink tank for storing an ink, a second ink tank capable of being separated from/connected to the first ink tank through an ink supply path, and a recording head for jetting an ink supplied from the second ink tank, and which carries out recording by jetting an ink from the recording head to a recording medium, the ink jet recording device comprising measuring means for measuring an elapsed time from an end of the previous recording; and supplying means for supplying an ink from the first ink tank to the second ink tank, wherein the ink supplying means supplies the ink from the first ink tank to the second ink tank if the elapsed time measured by the measuring means is less than a first threshold value; supplies the ink from the first ink tank to the second ink tank after a residual ink is jetted from the second ink tank, if the elapsed time is not less than the first threshold value and less than a second threshold value; and supplies the ink from the first ink tank to the second ink tank, and jets the ink from the second ink tank to supply the ink again, if the elapsed time is not less than the second threshold value.

A second aspect of the present invention is directed to an ink supplying method in an ink jet recording device which has a first ink tank for storing an ink, a second ink tank capable of being separated from/connected to the first ink tank through an ink supply path, and a recording head for jetting an ink supplied from the second ink tank, and which carries out recording by jetting an ink from the recording head to a recording medium, the ink supplying method comprising a measuring step of measuring an elapsed time from an end of previous recording; a comparing step of comparing the elapsed time measured in the measuring step with a first threshold value or a second threshold value; and a supplying step of supplying an ink from the first ink tank to the second ink tank in accordance with a result of the comparison in the comparing step, wherein in the ink supplying step, the ink is supplied from the first ink tank to the second ink tank if the elapsed time is less than the first threshold value; the ink is supplied from the first ink tank to the second ink tank after a residual ink is jetted from the second ink tank, if the elapsed time is not less than the first threshold value and it is less than the second threshold value; and the ink is supplied from the first ink tank to the second ink tank, and the ink is jetted from the second ink tank to supply the ink again, if the elapsed time is not less than the second threshold value.

According to the present invention, it is possible to prevent wasteful consumption of an ink by changing an ink supplying method carried out before printing in accordance with an elapsed time from the end of the previous printing. Moreover, there is suppressed the deterioration of an image caused by a concentration change of the ink due to a longer standing time, so that it is possible to always obtain a stable printing quality image.

DETAILED DESCRIPTION OF THE PREFERRED EMBODIMENT

Next, the present invention will be described in detail with reference to the accompanying drawings.

FIRST EMBODIMENT

Basic Constitution

A recording device comprises a printer main body which has a recording head, and a constitution pack in which recording media and an ink tank are roughly integrated (may be referred to as a media pack or a recording media pack, hereinafter). The embodiment will be described by way of a recording device which uses an integrated media pack. Needless to say, however, it's no problem to employ a constitution in which the recording media and the ink tank are separated from each other.

In the specification, recording (may be referred to as print or printing, hereinafter) represents not only a case of creating significant information such as characters or graphics but also significant and insignificant cases. Additionally, the recording represents a case of forming an image, a design, a pattern or the like on a recording medium or a case of processing the recording medium irrespective of visibility of an object which enables viewing by a human. The recording media represent not only paper used by a general recording device but also cloth, plastic films, metal plates, glass, ceramics, timbers, leather, etc., which can receive an ink, and they may be referred to as print media or recorded media. Further, the ink (may be referred to as a liquid, hereinafter) should be construed broadly as in the case of the definition of the recording (print). The ink represents a liquid which is applied on the recording medium to form an image, a design, a pattern or the like, or to process the recording medium. Alternatively, the ink represents a liquid which can be used for ink treatment (e.g., coagulation or insolubilization of a coloring material in the ink applied on the recording medium).

When printing is carried out by using the recording device of the embodiment, an image is recorded on the recording medium in a state in which the media pack is connected to the printer main body. The recording device supplies an ink stored in a first ink tank disposed in the media pack to a second ink tank mounted on a carriage, and carries out recording by using the ink in the second tank. For this ink supplying, a joint of the first ink tank and a needle (supply port) of the second ink tank are connected to each other to supply the ink. This constitution is referred to as pit-in supplying. Additionally, as a volume of the second ink tank is small compared with that of the first ink tank, the first ink tank is referred to as a main ink tank (may be referred to as a main tank), and the second ink tank is referred to as a sub ink tank (may be referred to as a subtank).

Figure 1:
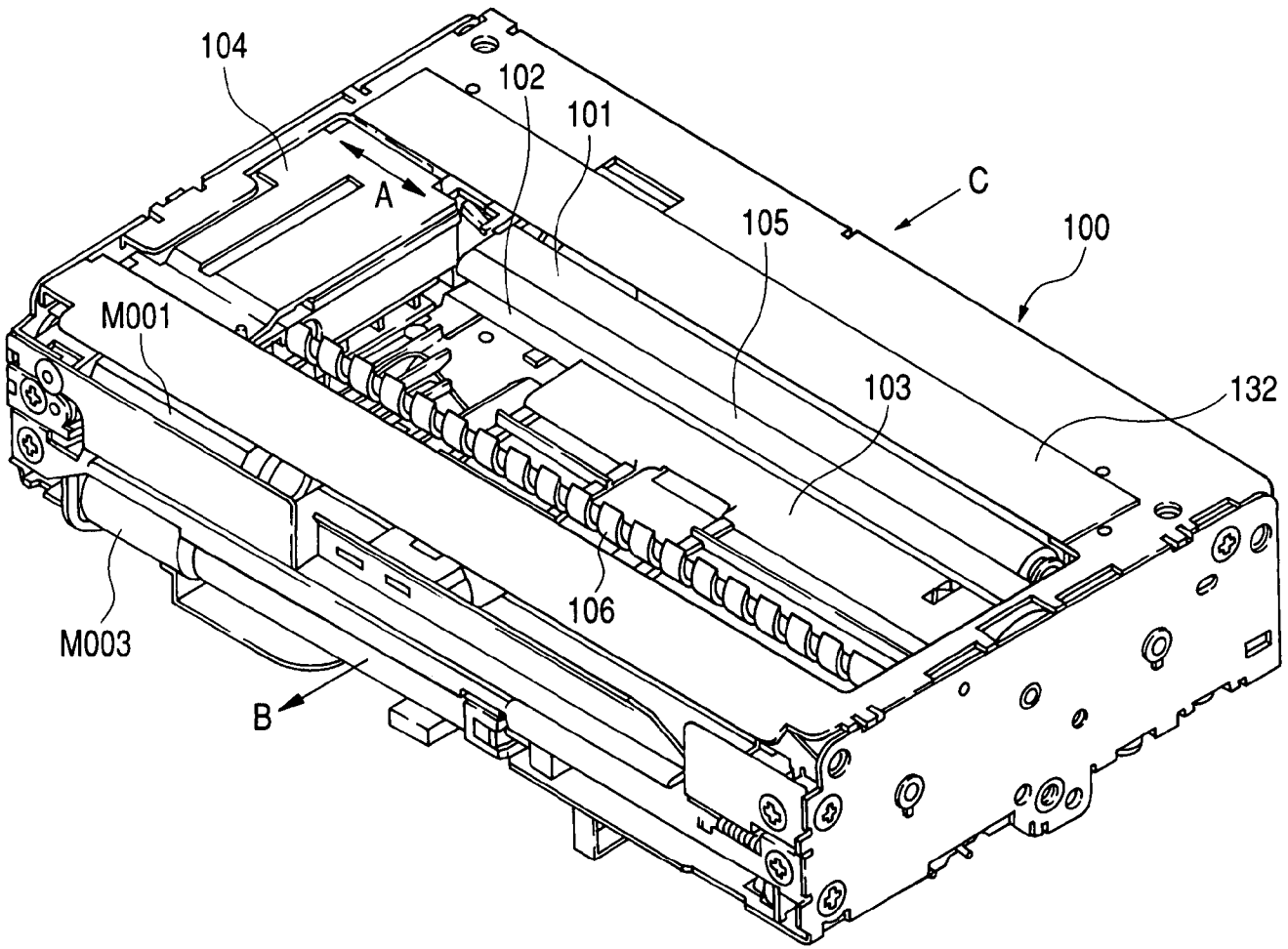
FIG. 1 is a perspective view of a printer.
Figure 2:
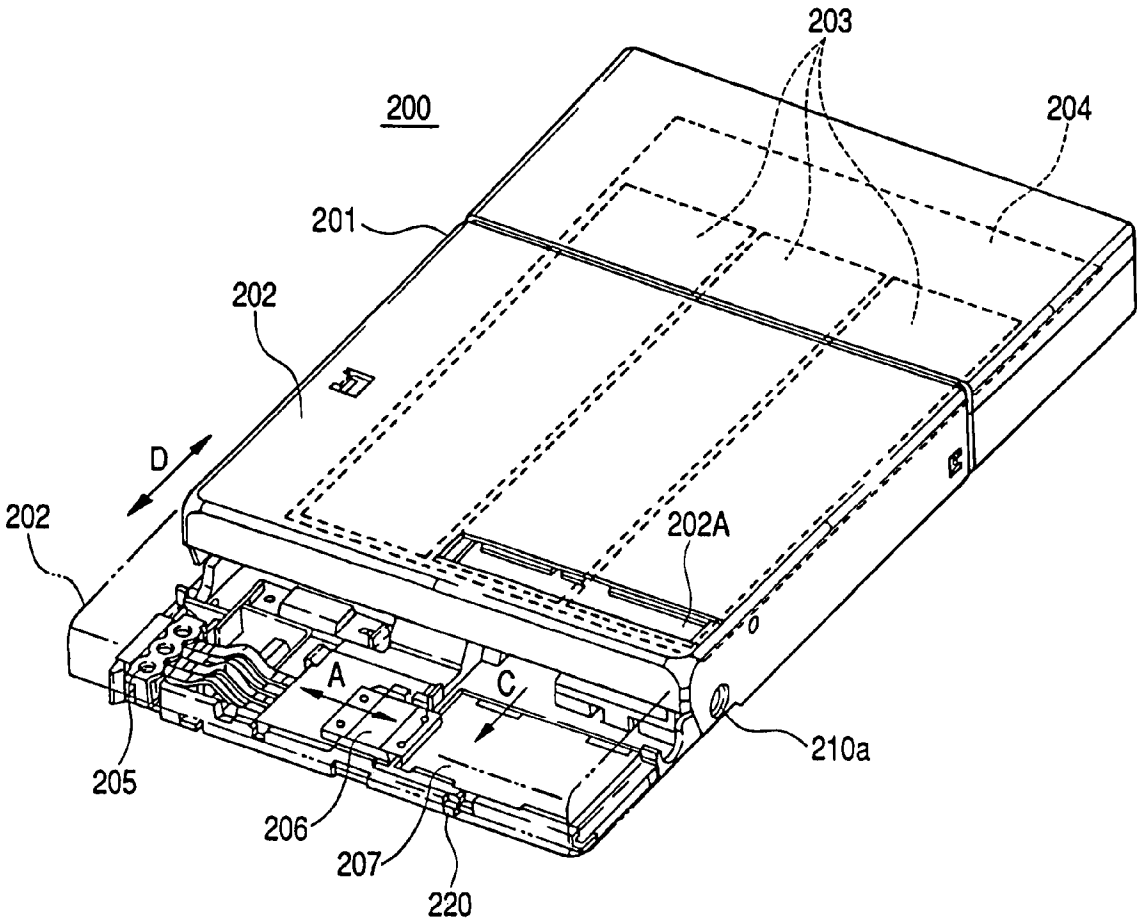
FIG. 2 is a perspective view of a media pack.
Figure 3:
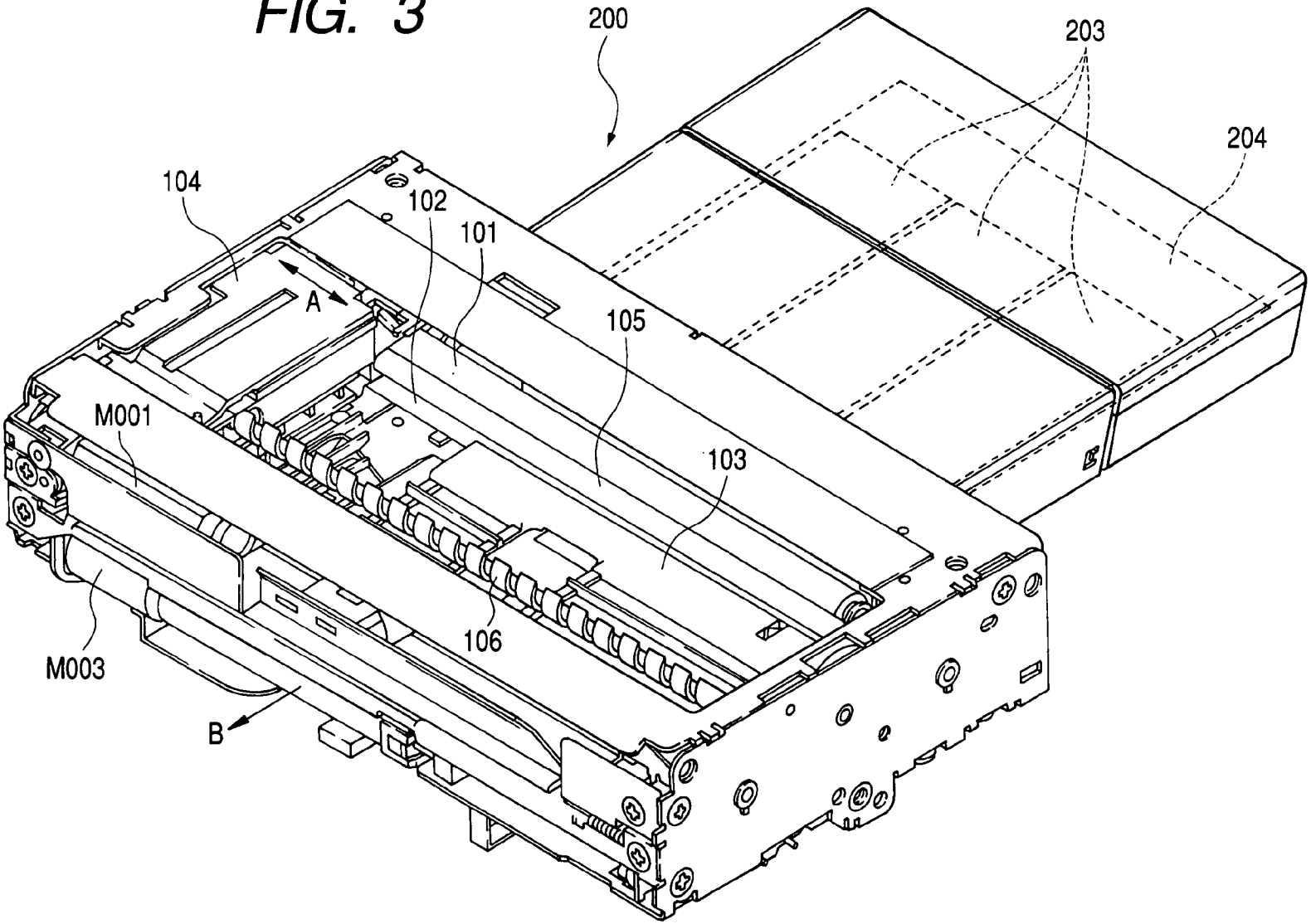
FIG. 3 is a perspective view of a state in which the media pack is inserted into the printer.
Figure 4:
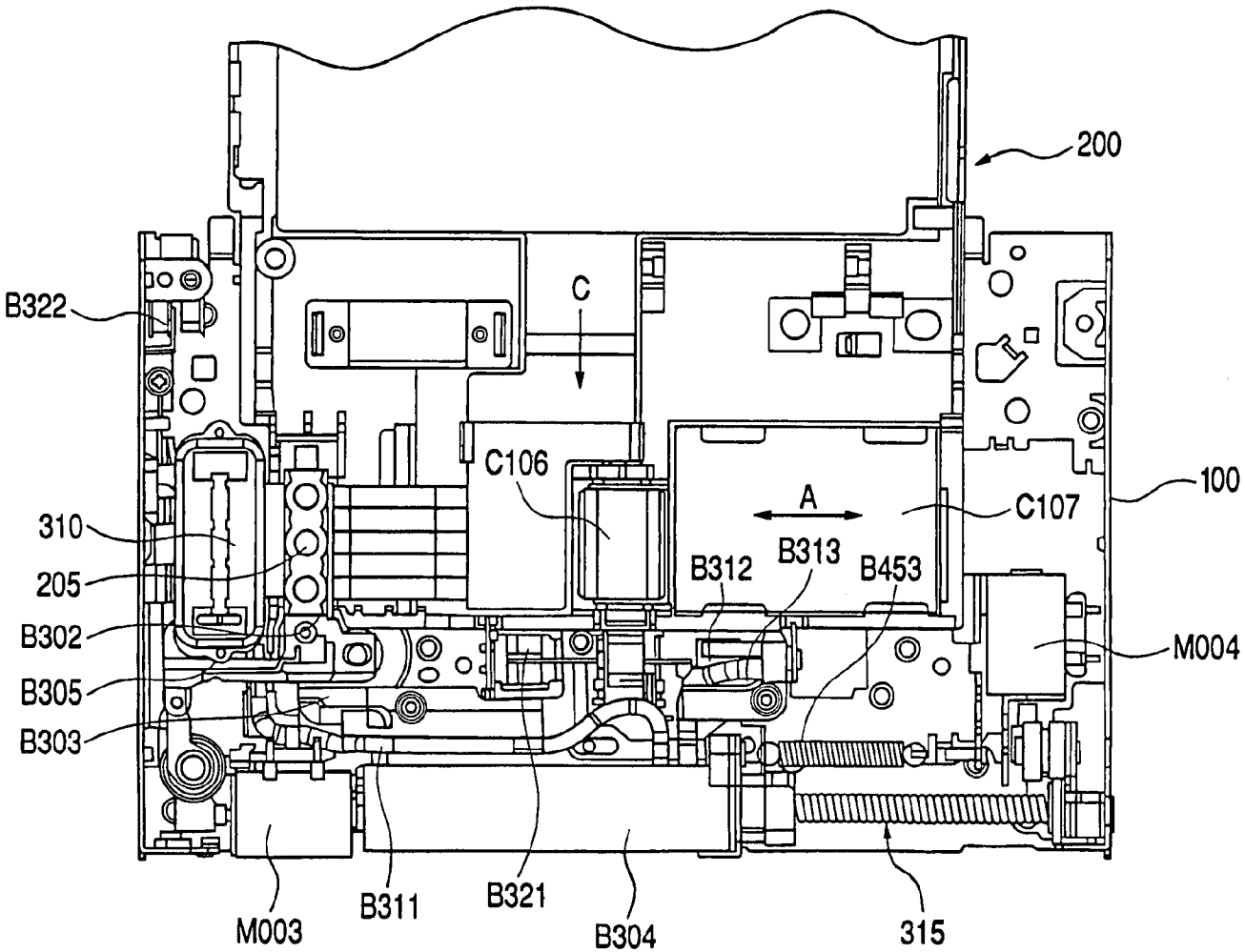
FIG. 4 is a perspective view of components in the printer of FIG. 1.

FIG. 1 is a general constitutional view showing a printer 100 of the recording device of the embodiment in a state in which exterior parts of the recording device are removed. FIG. 2 is a view showing a constitution of a media pack 200. FIG. 3 is a view showing a state in which the media pack 200 of FIG. 2 is mounted on the printer 100 of FIG. 1, and the state of FIG. 3 is set when recording is carried out. FIG. 4 is a view showing an internal constitution of the recording device when the media pack 200 is mounted on the printer 100.

Hereinafter, a basic constitution of the recording device of the embodiment will be described by being classified into A media pack and B printer.

A Media Pack

FIG. 2 is an appearance view showing the entire media pack 200. The media pack 200 can be detachably mounted on the printer 100 of the recording device main body.

As shown in FIG. 2, a pack main body 201 of the media pack 200 comprises a shutter 202 which can be slid in an arrow direction D. The shutter 202 is slid to a position indicated by a double-dashed chain line in FIG. 2 when the media pack 200 is not mounted on the printer 100. The shutter 202 is slid to a position indicated by a solid line in FIG. 2 when the media pack 200 is mounted on the printer 100.

The pack main body 201 houses an ink pack (equivalent to the main tank) 203 and a print medium 204. According to the embodiment, the ink pack 203 is housed below the print medium 204, and three ink packs 203 are disposed to individually contain inks of yellow (Y), magenta (M) and cyan (C). About twenty print media 204 are stacked to be housed. Incidentally, the inks of yellow (Y), magenta (M) and cyan (C) are individually contained in the ink packs 203 according to the embodiment, but a constitution may be employed in which a black (Bk) ink may be contained in addition to the three colors.

A combination of kinds of inks and print media contained in the media pack 200 is selected so that an optimal image can be formed if recording is carried out by using the ink and the print medium contained in the same media pack. Accordingly, a plurality of media packs 200 different in combinations of inks and print media are prepared, and packs can be selected from the plurality of media packs 200 to be mounted on the printer 100 of the recording device in accordance with kinds of images to be recorded and use of print media on which images are formed. As kinds of print media, there are photographic glossy paper used for ultra-high image quality recording, glossy paper or half-glossy paper used for normal image recording, etc. Additionally, regarding use of the print media, there are a print medium of an L photo size, a print medium of a name card/card size, a print medium on a backside of which a sealing material is used, a divided seal medium in which one print medium is divided by a plurality of small seals, etc.

Thus, by integrally containing the inks and the print media of the optimal combination in the media pack 200, and by using the media pack selected by a user in accordance with image quality and a purpose such as the use of a print, an optimal image can be surely recorded. Incidentally, the media pack 200 comprises an EEPROM for identification (may be referred to as identification IC). This EEPROM stores identification data on kinds of inks and print media contained in the media pack 200, and residual amounts of the inks and the print media.

The ink packs 203 are connected through three joints 205 (may be referred to as rubber joints) corresponding to the inks of Y, M, C to an ink supplying system of the printer 100 (described later) when the media pack 200 is mounted on the printer 100.

Further, the media pack 200 comprises a wiper 206 for wiping the recording head of the printer (described later), and a waste ink absorber 207 for absorbing a waste ink jetted from the printer. An arrow A in FIG. 2 indicates a direction in which the recording head of the printer is reciprocated, and this direction of the arrow A is referred to as a main scanning direction. When the recording media pack 200 is removed from the device main body, the shutter 202 is slid to the position of the double-dashed chain line in FIG. 2 to protect the joint 205, the wiper 206, the ink absorber 207, etc.

B Printer

FIG. 1 is a constitutional view showing the printer of the recording device of the embodiment. The printer 100 shown in FIG. 1 is an ink jet recording device of a serial type which carries out recording by reciprocating an ink jet recording head. This printer 100 will be described by being divided into B1 printing operation section and B2 ink supplying/recovering system.

B1 Printing Operation Section

Figure 5:
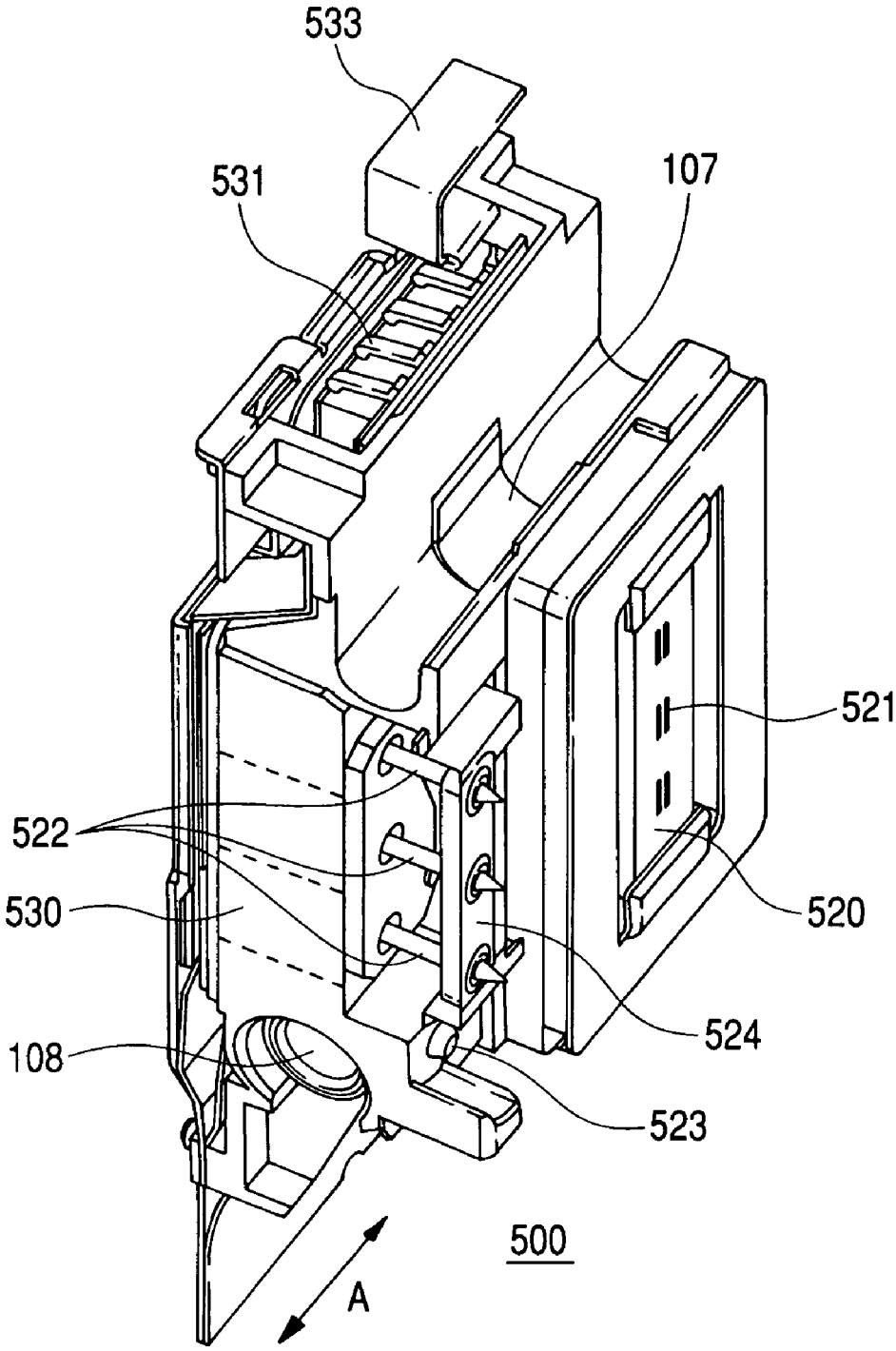
FIG. 5 is a perspective view of a recording head.

FIG. 5 is a perspective view showing a recording head unit 500 mounted on the recording device. This recording head unit 500 forms an image by being reciprocated in the main scanning direction to jet an ink to a print medium. In the recording head unit 500, a recording head 520 capable of jetting inks of Y, M, C, a second ink tank (subtank) 530 for storing an ink supplied to the recording head 520, and a carriage 108 are integrally constituted. The subtank 530 comprises tanks for storing the inks of Y, M, C. In the recording head 520, a plurality of ink outlets 521 are formed to be arrayed in a direction which intersects the main scanning direction of the arrow A in FIG. 5. According to the embodiment, the main scanning direction and the arraying direction of the ink outlets 521 are orthogonal to each other.

Each ink outlet 521 is a nozzle through which an ink supplied from the subtank can be jetted. Additionally, according to the embodiment, an electric heat converter disposed for each nozzle is used as energy generating means for jetting an ink. The electric heat converter is driven to generate heat, thereby generating bubbles in the ink in the nozzle, and ink drops are jetted through the ink outlet 521 by the bubble generation energy. Incidentally, an electromechanical converter may be used as energy generating means for jetting an ink.

The subtank 530 has a capacity smaller than that of the main tank 203 housed in the media pack 200 of FIG. 2, and a size to contain the amount of an ink necessary for image recording on at least one print medium 204. Ink supplying sections and negative pressure introducing sections are formed in ink containing sections of the subtank 530 for containing the inks of Y, M, C. The ink supplying sections are individually connected to corresponding three hollow needles 522, and the negative pressure introducing sections are connected to a common supply air port (gas suction port) 523. For the ink containing sections (ink supplying sections) of the respective colors of the subtank 530, sponges are used as ink absorbers such as polypropylene fibers for absorbing and holding the inks. The needles (ink intaking sections) 522 disposed in the ink containing sections have through-holes which are projected downward. The three needles 522 can be connected to the three rubber joints 205 of the media pack 200 when the recording head unit 500 is moved to a home position.

Incidentally, two or three inks may be contained in the subtank 530. When the recording head unit 500 is moved to the home position (HP) of the recording device, the subtank 530 is replenished with an ink from the main tank 203 of the media pack 200 of FIG. 2 through the joint 205.

A reference numeral 524 is a needle cover. As shown in FIG. 5, this needle cover 524 is moved to a position to protect the needle 522 by a spring force when the needle 522 is not connected to the joint 205. When the needle 522 is connected to the joint 205, the needle cover 524 is moved to a position to release the projection of the needle 522 against the spring force (moved downward in FIG. 5).

A reference numeral 531 is an encoder sensor, and a reference numeral 533 is an HP flag for detecting the movement of the recording head unit 500 to the home position. Position detection when the recording head unit 500 is moved in the main scanning direction is carried out by using a linear scale 132 (see FIG. 1) of the printer 100, and the encoder sensor 531. Additionally, the detection of the movement of the recording head unit 500 to the home position is carried out by using the HP flag 533, and an HP sensor (not shown) of the printer 100.

The recording head 520 is moved in the main scanning direction of the arrow A of FIG. 5 together with the recording head unit 500 to jet an ink through the ink outlet 521 in accordance with an image signal, thereby recording an image of one scanning on the print medium on a platen 103 (see FIG. 1) of the printer 100. An image is formed on the print medium by repeating the recording operation of one scanning by the recording head 520 and a conveying operation of a predetermined amount of the print medium by a print medium conveying system (described later).

B2 Ink Supplying/Recovering System

Figure 6:
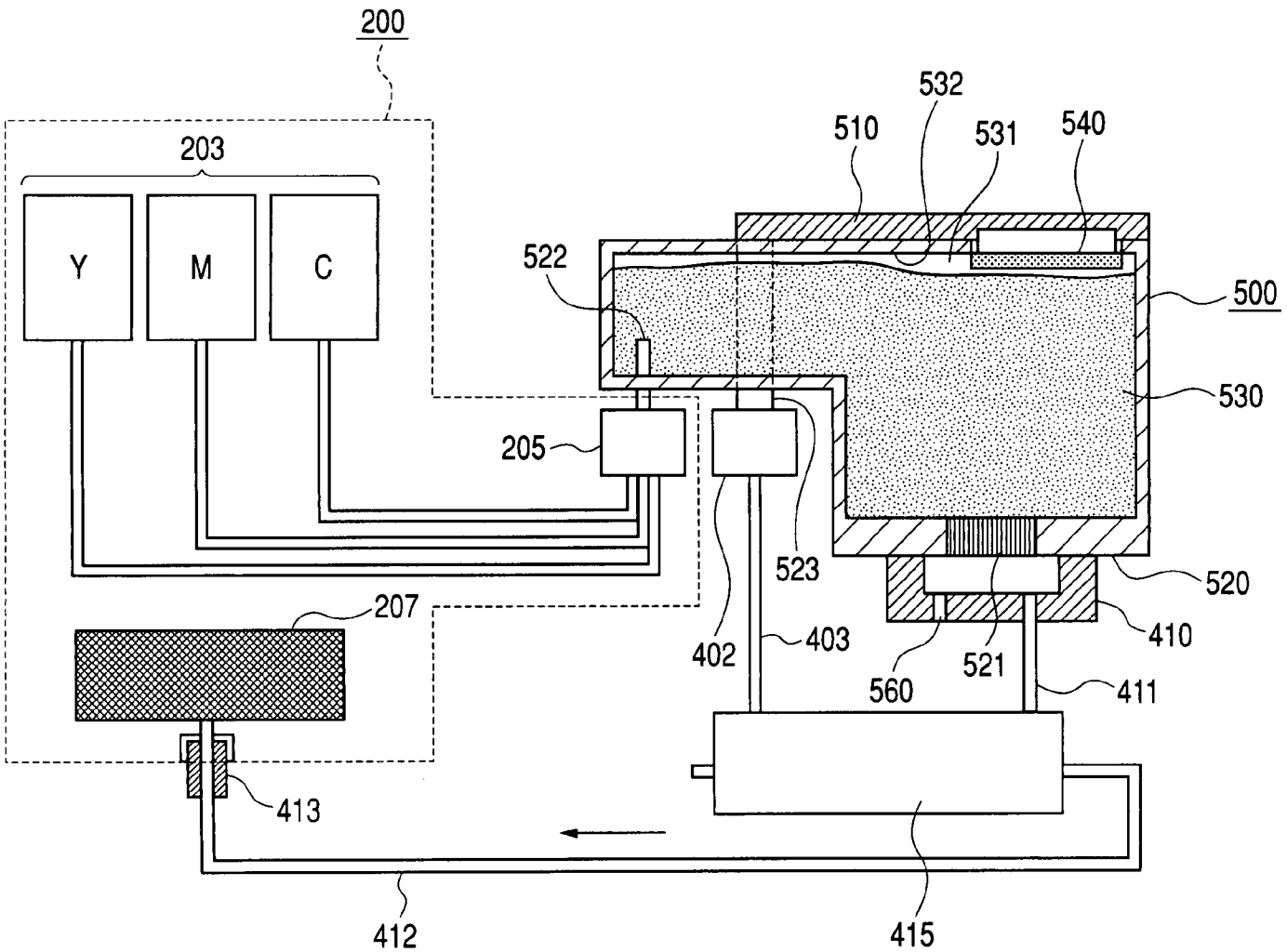
FIG. 6 is a schematic view of an ink supplying/recovering system.

FIG. 6 is a schematic view of a section regarding ink supplying/recovering when the media pack 200 is mounted on the printer 100.

When the media pack 200 is mounted on the printer 100, the joint 205 is positioned below the needle 522 of the recording head unit 500 moved to the home position. The joint 205 of the media pack 200 is moved up by a joint fork (not shown) disposed in the device of the printer 100, whereby the joint 205 and the needle 522 of the recording head unit 500 are connected to each other. By the connection of the joint 205 and the needle 522, an ink supply path is formed between the main tank 203 of the media pack 200 and the subtank 530 of the recording head unit 500. Thus, the predetermined amount of an ink can be supplied from the main tank 203 to the subtank 530.

The printer 100 comprises a supply joint 402 below the supply air port 523 (see FIG. 5) of the recording head unit 500 moved to the home position. Incidentally, the supply air port 523 may be referred to as a gas suction port. The supply joint 402 is connected through a supply tube 403 to a pump cylinder 415 for generating a negative pressure. An up-and-down movable joint lifter (not shown) is moved up, whereby the supply joint 402 is moved up to be connected to the supply air port 523 of the recording head unit 500. By the connection of the joint lifter to the supply air port 523, a negative pressure introducing path is formed between the negative pressure introducing section of the subtank of the recording head unit 500 and the pump cylinder 415.

A reference numeral 510 is a negative pressure introducing section formed above the ink supplying section of each color of the subtank 530. A reference numeral 540 is a gas-liquid separating member subjected to water-repelling and oil-repelling treatment. The gas-liquid separating member 540 is made of a porous membrane which permits the passage of air but blocks the passage of the ink. Incidentally, the negative pressure introducing section 510 may be referred to as a gas passage, and the gas-liquid separating member 540 may be referred to as a gas passing member. A reference numeral 531 shown in FIG. 6 is a space in which air is present. An inner wall surface (e.g., surface denoted by 532) of the space 531 is preferably adapted to suppress ink sticking as much as possible, and subjected to surface treatment such as water-repelling treatment.

To supply an ink from the main tank 203 to the subtank 530, the pump cylinder 415 sucks air from the subtank 530 through the negative pressure introducing section 510 and the gas passing member 540 to increase a negative pressure in the subtank, and the ink supplying from the main tank 203 to the subtank 530 is carried out by using the negative pressure. During the ink supplying from the main tank 203 to the subtank 530, the gas-liquid separating member 540 does not permit the passage of the ink. Thus, the ink supplying is automatically stopped when a liquid surface of the ink supplied into the subtank 530 reaches the gas-liquid separating member 540. This gas-liquid separating member 540 may be referred to as an ink filling-up valve.

Incidentally, in the specification, the constitution in which the main tank 203 and the subtank 530 are not connected to each other during general printing and, when the ink is supplied from the main tank 203 to the subtank 530, these tanks are connected through the ink supply path to execute the ink supplying is referred to as a pit-in ink supplying system, and especially an ink supplying operation in this constitution is referred to as a pit-in operation.

Figure 7A:
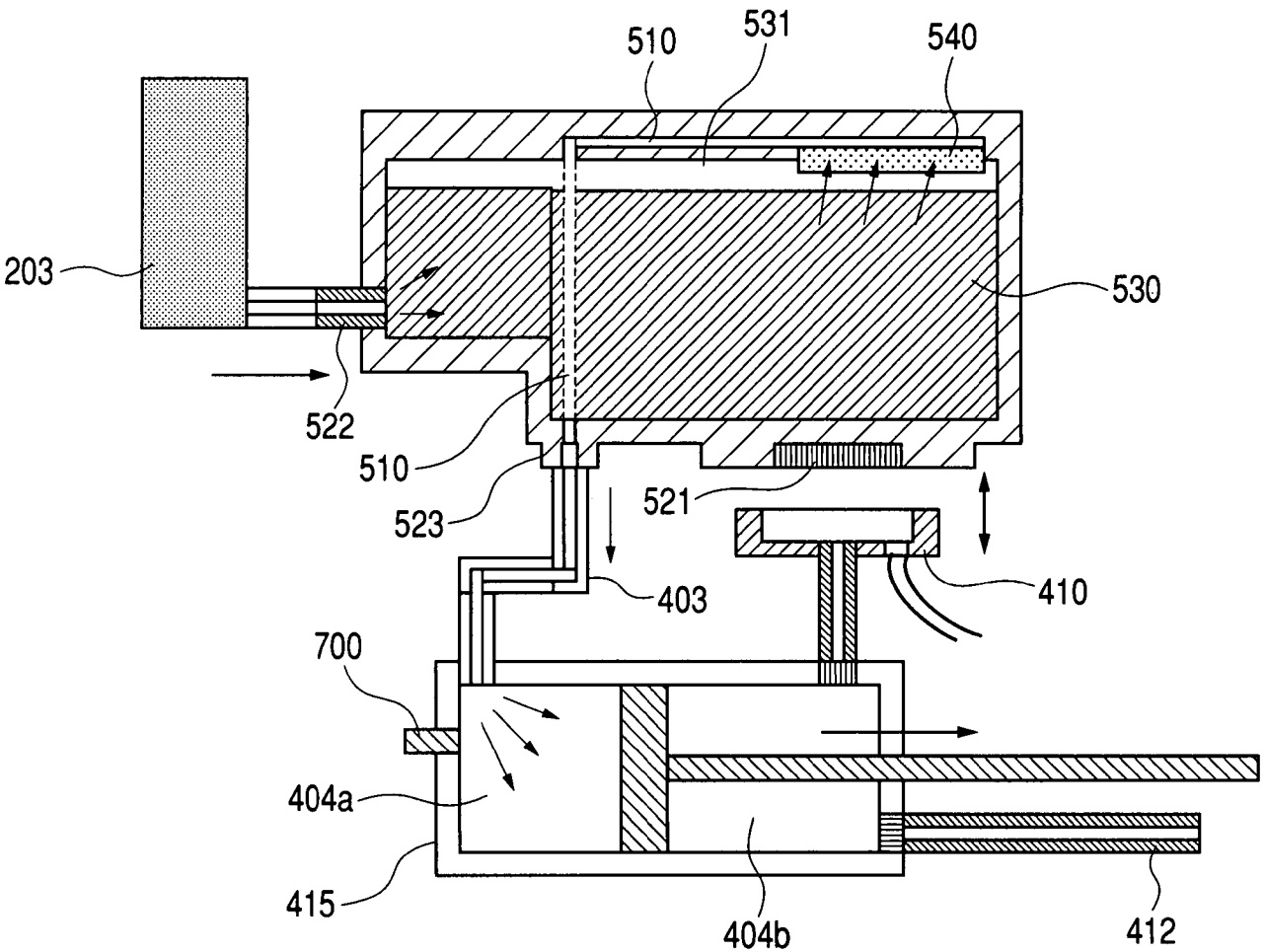
FIGS. 7A and 7B are views showing a conceptual configuration of the ink supplying/recovering system.
Figure 7B:
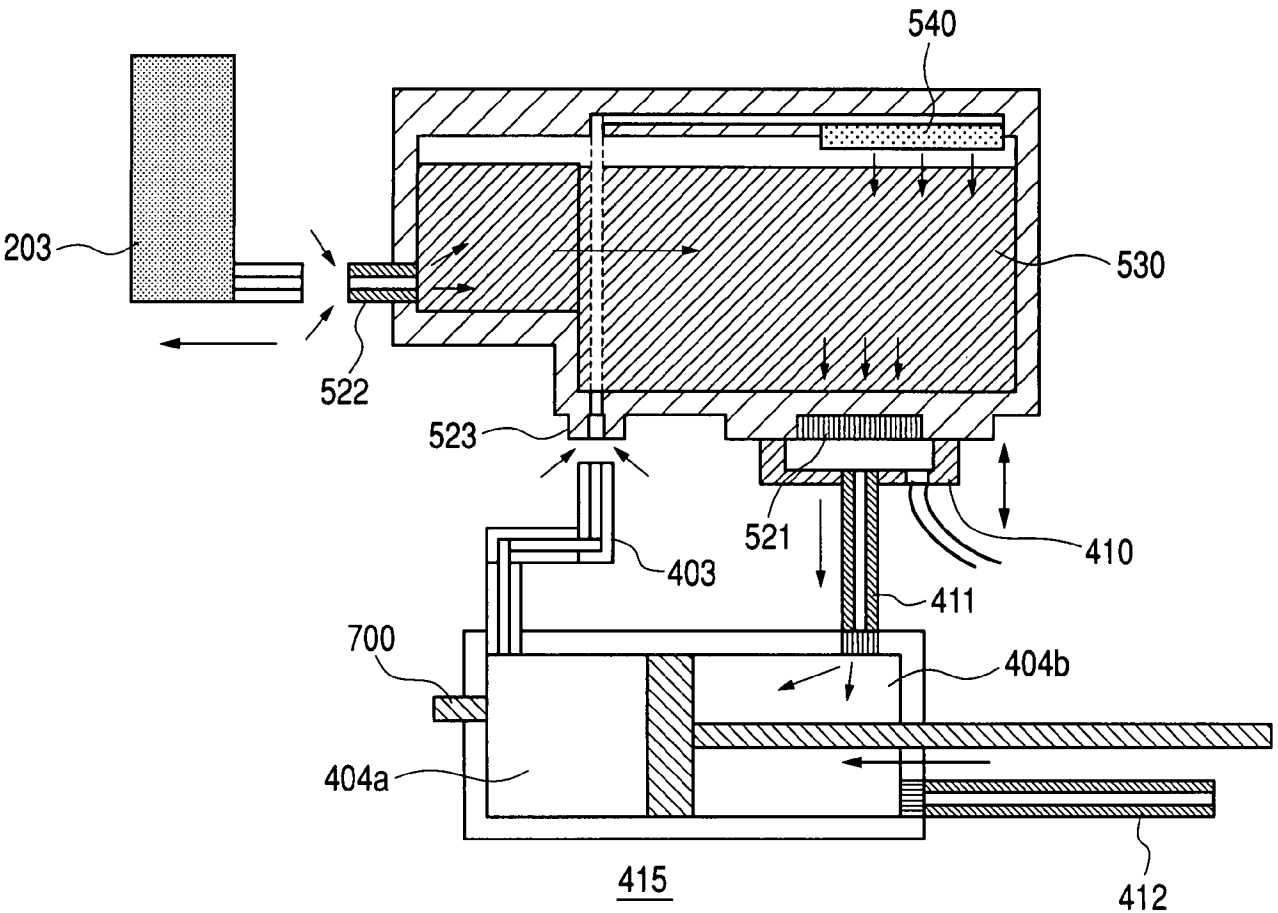

FIGS. 7A and 7B are schematic views showing a constitution of a pump unit. FIG. 7A shows a movement of the pump unit when an ink is supplied, and FIG. 7B shows a movement of the pump unit when a recovery operation is carried out to suck an ink from the recording head.

FIG. 7A shows a state in which a piston of the pump cylinder 415 is moved in a predetermined direction (right direction in the drawing). The movement of the piston in the predetermined direction shown in FIG. 7A enables sucking of the air from the subtank 530 through the supply air port 523 (may be referred to as an air suction port) communicated from the gas-liquid separating member 540. The pump cylinder 415 sucks the air from the subtank 530, whereby the ink is supplied from the main tank 203 of the media pack 200 to the subtank 530. When the ink is sufficiently supplied to the subtank 530, and the ink in the subtank reaches the gas-liquid separating member 540, the ink supplying is automatically stopped so as to block the passage of the ink through the gas-liquid separating member 540.

After the supplying of the ink into the subtank 530, the joint 205 is separated from the needle (connection port for supplying) 522, and the supply joint 402 is separated from the supply joint supply air port 523. Further, when necessary, the pump cylinder 415 is driven to suck the ink from the subtank, thereby making preparations for a recording operation.

FIG. 7B shows a state in which the pump cylinder 415 is moved in a direction (left direction in the drawing) reverse to that of FIG. 7A. A cap 410 is abutted on a surface of the recording head 520 in which the ink outlet 521 is formed. The piston is moved in a direction reverse to that during the ink supplying as shown in FIG. 7B, whereby the ink is sucked through the cap 410 from the recording head 520, and the ink is jetted through the ink outlet 521. The operation of sucking the ink from the recording head 520 and jetting the ink, thereby restoring a good jet state through the ink outlet 521, is referred to as a suction recovery operation (may be simply referred to as a recovery operation). This recovery operation is carried out after ink supplying, when no recording is carried out for a predetermined period, or when power is turned ON. Additionally, an atmosphere communication port 560 is formed in the cap 410 to communicate the inside of the cap with an atmosphere. The atmosphere communication port 560 can be opened/closed by an atmosphere communication valve (not shown). For a jetting operation to jet all the inks from the subtank 530, the pump cylinder 415 is driven as shown in FIG. 7B to carry out the jetting operation.

Next, the specific operation of ink supplying and jetting will be described.

As shown in FIG. 7A, when ink supplying is carried out, first, the recording head unit 500 is moved to an ink supplying position (pit-in ink supplying position). This ink supplying position may also serve as a home position in which the cap 410 is present, or an ink supplying position may be separately set. Next, the subtank 530 is connected to the main tank 203. The connection of the subtank 530 to the main tank 203 uses a force when the carriage on which the recording head unit 500 is mounted is moved on an axis. As the other connecting method, a lever or the like of a mechanism of lifting up the main tank 203 may be disposed, and driving means different from that of the carriage may be used to connect the tanks by the lever (e.g., FIG. 6).

Next, in order top cause the pump cylinder 415 to carry out a suction operation for removing the gas from the subtank 530, the supply air port 523 and the pump cylinder 415 are connected to each other. When the ink is supplied to the subtank 530, the piston of the pump cylinder 415 is moved to increase a volume of an air suction chamber 404*a*. The gas passage 510 is formed from the pump cylinder gas-liquid separating membrane 540 to the supply air port 523 inside or outside the subtank 530. When sucked by the pump cylinder 415, the gas is moved from the subtank 530 through the gas-liquid separating membrane 540 and through the gas passage 510 into the suction chamber 404*a*. The suction by the pump cylinder increases the negative pressure in the subtank 530 to supply the ink from the main tank 203 to the subtank 530. When the ink is supplied to fill the subtank, the ink in the subtank 530 cannot be passed through the gas-liquid separating membrane 540, and thus the ink supplying from the main tank 203 to the subtank 530 is stopped. When a negative pressure in the gas suction chamber 404*a* is increased to become a predetermined negative pressure, a pressure regulating valve 700 is opened to make a pressure constant in the gas suction chamber 404*a*. By the opening/closing of the pressure regulating valve 700, the negative pressure in the gas suction chamber 404*a* is controlled not to exceed a predetermined value. Accordingly, it is possible to prevent the passage of the ink through the gas-liquid separating membrane 540 which occurs due to an excessively high negative pressure in the subtank 530 even if the subtank is filled up with the ink. If the pressure regulating valve 700 is not disposed, a high negative pressure is applied in the subtank 530, and the ink is passed through the gas-liquid separating membrane 540, there is a danger that a function of the gas-liquid separating membrane 540 will be lost.

Specific description will be made of an ink jetting operation carried out after the ink supplying by referring to FIG. 7B.

First, the main tank 203 and the subtank 530 which have been connected are separated from each other, and a capping operation is carried out to abut the cap on the surface of the recording head 520 in which the ink outlet 521 is formed. In this case, this operation is omitted if the cap has been abutted. Next, the negative pressure introducing section of the subtank 530 and the pump cylinder which have been connected are separated from each other. When the ink is jetted from the recording head 520, the piston of the pump cylinder 415 is moved in a direction reverse to that during the ink supplying to increase a volume of an ink suction chamber 404*b*, thereby executing a suction operation to such the ink from the recording head 520. When the suction operation is executed, the air is drawn into the subtank 530 through the needle (connection port for supplying) 522 which is a connection portion between the subtank 530 and the main tank 203, and the supply air port 523 which is a connection portion between the subtank 530 and the pump cylinder 415. After the drawing of the gas through the needle (connection port for supplying) 522 into the subtank 530, a free ink which is present in the subtank 530 but not held in the absorber, and which is present in a flow path or the like in a freely movable state is sucked to be removed, and accordingly a predetermined negative pressure state can be maintained in the subtank 530 which includes the ink absorber. Additionally, after the drawing of the gas through the supply air port 523 into the subtank 530, an ink in contact with the gas-liquid separating membrane 540 is drawn downward to fall, whereby the gas-liquid separating membrane 540 is caused to function again. It is advisable to carry out a wiping operation for wiping off an ink stuck to the surface in which the ink outlet 521 is formed, or an extra jetting operation (or pre-discharge operation) for jetting an ink which does not contribute to image recording into the cap 410 after the aforementioned ink jetting operation. These operations can improve an ink jetting state after the ink supplying.

When printing is carried out, the recording device of the embodiment carries out the extra jetting operation for jetting the ink which does not contribute to image recording into the cap 410 at the time of cap opening in a state in which the cap 410 is moved apart from the formation surface of the ink outlet 521 before a start of printing, or during the printing. This extra jetting operation enables stable jetting of the ink through the ink outlet 521. An air suction operation is carried out to jet the ink jetted into the suction cap 410 from the pump cylinder 415 through a waste liquid tube 412 and a waster liquid joint 413 to a waste ink absorber 207 in the media pack 200. Incidentally, in the case of a device which comprises an extra jet receiver capable of containing the extra jetted ink in addition to the cap 410, the extra jetting operation may be carried out not into the cap 410 but into the extra jet receiver. Needless to say, if the jetting operation is carried out into the extra jet receiver, it is not necessary to execute the air suction operation in the cap.

According to the present invention, when printing is carried out, it is possible to always maintain stable image quality by measuring an elapsed time from the end of the previous printing and executing an optimal sucking/recovering method in accordance with the elapsed time.

If the ink of the subtank 530 is left for a long time, moisture of the ink is evaporated to increase ink concentration. This is attributed to the constitution in which the subtank 530 is communicated with the atmosphere through the needle 522 or the supply air port 523. The subtank 530 is resourcefully constituted by using a material of relatively high gas permeability, but still the moisture is evaporated if the ink is left in a low-humidity environment for a long time.

Figure 8:
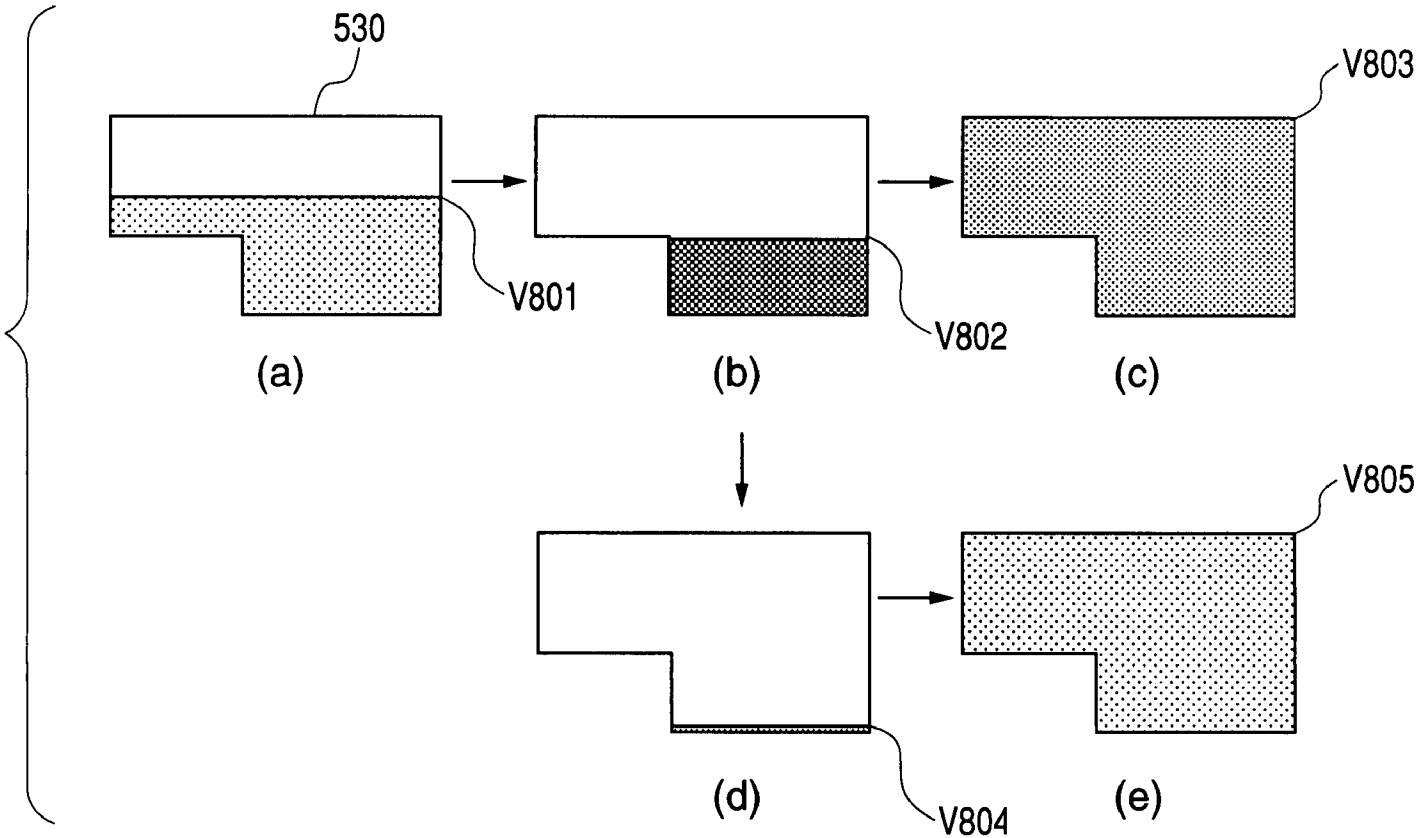
FIG. 8 is a view showing ink states in subtanks.

FIG. 8 is a schematic view showing an ink state in the subtank 530.

(a) in FIG. 8 shows the amount of a residual ink in the subtank 530 at the time of the end of printing, in which an ink of V801 remains. (b) in FIG. 8 shows the amount of a residual ink in the subtank 530 when the ink is left in the state of (a) in FIG. 8 for a relatively long time, in which because of the long-time leaving moisture or alcohol which is a volatile component in the ink is evaporated to reduce an ink volume to V802, and the ink is condensed to increase coloring material concentration of the ink. (c) in FIG. 8 shows a state in which the subtank 530 is filled up with a new ink from the state of (b) in FIG. 8, and an ink volume is V803. In (c) in FIG. 8 which shows a mixture of the condensed ink and the general ink, coloring material concentration of the ink of (c) in FIG. 8 is increased more than that of the general ink in accordance with the concentration of the ink left for the long time to become thick. If the next printing is carried out in such a state in which the coloring material concentration is increased more than generally, printing concentration may become high, or a color tone may be shifted during color recording by subtractive color mixing.

However, based on the elapsed time from the end of the previous printing, a stable image can be formed by jetting an ink whose coloring material concentration is increased if the ink is left for a long time (V804 (d) in FIG. 8), and then filling the subtank 530 with an ink to set an ink volume to V805 (e) in FIG. 8.

Next, detailed description will be made of an ink supplying method based on the elapsed time from the end of the previous printing in the ink supplying system of the present invention.

According to the ink supplying system of the invention, as a result of an ingenious reduction of the amount of moisture evaporation in an ink, it is possible to predict the amount of moisture evaporation in an environment. Specifically, when the ink is left in an environment of a temperature 30° C. and humidity 10%, the amount of evaporation is 2 mg/day. If the amount of moisture evaporation in the ink of the subtank 530 is known in a predetermined environment, it is possible to calculate the amount of an increase in coloring material concentration of the ink of the subtank 530. Further, by calculating the increase amount of the coloring material concentration, it is possible to obtain a color difference ΔE between an image printed by using the ink whose coloring material concentration is increased and an image printed by using the general ink. Accordingly, it can be judged that if the color difference ΔE obtained based on a standing time and the environment is equal to/lower than a predetermined value, a stable image can be formed even if an ink is added to the residual ink in the subtank 530, whereas if the color difference ΔE is larger than the predetermined value, a stable image cannot be formed unless an ink is supplied after the residual ink is jetted.

According to the studies by the inventors of the present invention, a color difference ΔE=5 or lower is a permissible value of a color difference which gives no uncomfortable visual feeling. Based on this value of the color difference ΔE, a threshold value (first threshold value) of an elapsed time for selecting a supplying method is set. If an elapsed time from the end of the previous printing is larger than the first threshold value, an ink is supplied after the condensed ink is jetted from the subtank 530 to prepare for the printing.

Additionally, the inventors of the invention have discovered that when the elapsed time from the end of the previous printing is very long, even if the ink is supplied after the condensed ink is jetted from the subtank 530, ink coloring material concentration is high compared with the general ink, and a stable image cannot be formed. According to an experiment made by the inventors, viscosity of an ink in the subtank 530 becomes very high if the subtank is left in an environment of a temperature 30° C. and humidity 10% for about 30 days. In such a case, the viscosity-increased ink in the subtank 530 must be made thin to flow. Specifically, an ink is added from the main tank 203 to the viscosity-increased ink in the subtank 530 and left for a predetermined time (several seconds). By adding the ink to the viscosity-increased ink and leaving it for the predetermined time, the ink which remains in the subtank 530 to be condensed to increase its viscosity is mixed with the newly supplied ink to be able to flow. The standing time must be changed from 1 second to about 10 seconds depending on a kind of an ink. Thus, by adding the ink to the viscosity-increased ink in the subtank 530, jetting all the inks from the subtank 530 after an elapse of a predetermined time, and supplying an ink again from the main tank 203 to the subtank 530, a stable image can be formed. An elapsed time from the end of the previous printing until the viscosity of the ink in the subtank 530 becomes very high is set as a second threshold value.

According to the embodiment, for measurement of the elapsed time from the end of the previous printing, the time is managed by means capable of measuring a time such as an internal timer which is disposed in the recording device to be operated by a coin battery. Specifically, a time is stored in a nonvolatile memory of the recording device at the end time of a previous printing operation, a time of the internal timer of the recording device is obtained when a next printing signal is entered, and an elapsed time is calculated based on the time information of the nonvolatile memory and the obtained time information. This calculated elapsed time is judged with the first threshold value, the second threshold value stored in the memory of the recording device to select an ink supplying operation.

If the calculated elapsed time is less than the first threshold value, a general pin-in operation is carried out to add an ink from the main tank 203 to the residual ink in the subtank 530. Incidentally, the first threshold value is set to a value to thereby enable such judgment that when color difference ΔE=5 or lower is set and the elapsed time is less than the first threshold value, there is no uncomfortable feeling between an image printed by using only a general ink and an image printed by using the ink added to the residual ink. When the ink supplying is finished, a recovery operation is carried out to suck the predetermined amount of an ink through the ink outlet 521, and wiping and extra jetting are executed to finish a preparatory operation before the printing. Subsequently, the printing is started, and a desired image is outputted based on printing data.

If the calculated elapsed time is not less than the first threshold value and less than the second threshold value, a suction operation is carried out to jet the residual ink from the subtank 530, and then a pin-in operation is carried out to supply an ink from the main tank 203 to the subtank 530. After the ink supplying, a recovery operation or the like is carried out to finish a preparatory operation before the printing. Incidentally, the second threshold value is set equivalent to a leaving period of the subtank 530 until the residual ink therein is condensed to set its viscosity so high that even if an image is printed by using an ink supplied after the residual ink is jetted from the subtank 530, a color difference from an image printed by using a general ink is judged to be large, and an uncomfortable visual feeling is judged to be present.

If the calculated elapsed time is not less than the second threshold value, first, an ink is added from the main tank 203 to the residual ink of the subtank 530. Then, the ink is left for a predetermined time, and the ink is sucked from the subtank 530 to be jetted, and an ink is supplied again from the main tank 203. After the ink supplying, a recovery operation or the like is carried out to finish a preparatory operation before the printing.

The ink supplying system of the present invention is designed to store the amount of an ink necessary for the printing in the subtank 530, and to supply an ink from the main tank 203 of the recording device periodically or at each end of the printing on a predetermined number of media by a pin-in operation. Thus, because of the system to contain the ink in the container which is not tightly closed, the moisture of the ink in the subtank 530 is evaporated with time, whereby the coloring material concentration of the ink in the subtank 530 is increased, and a viscosity-increased state of the ink itself occurs. Such an ink state change has a big influence on a recorded image. According to the present invention, a stable image is formed by executing an optimal ink supplying operation even in this system.

Figures 9, 9A:
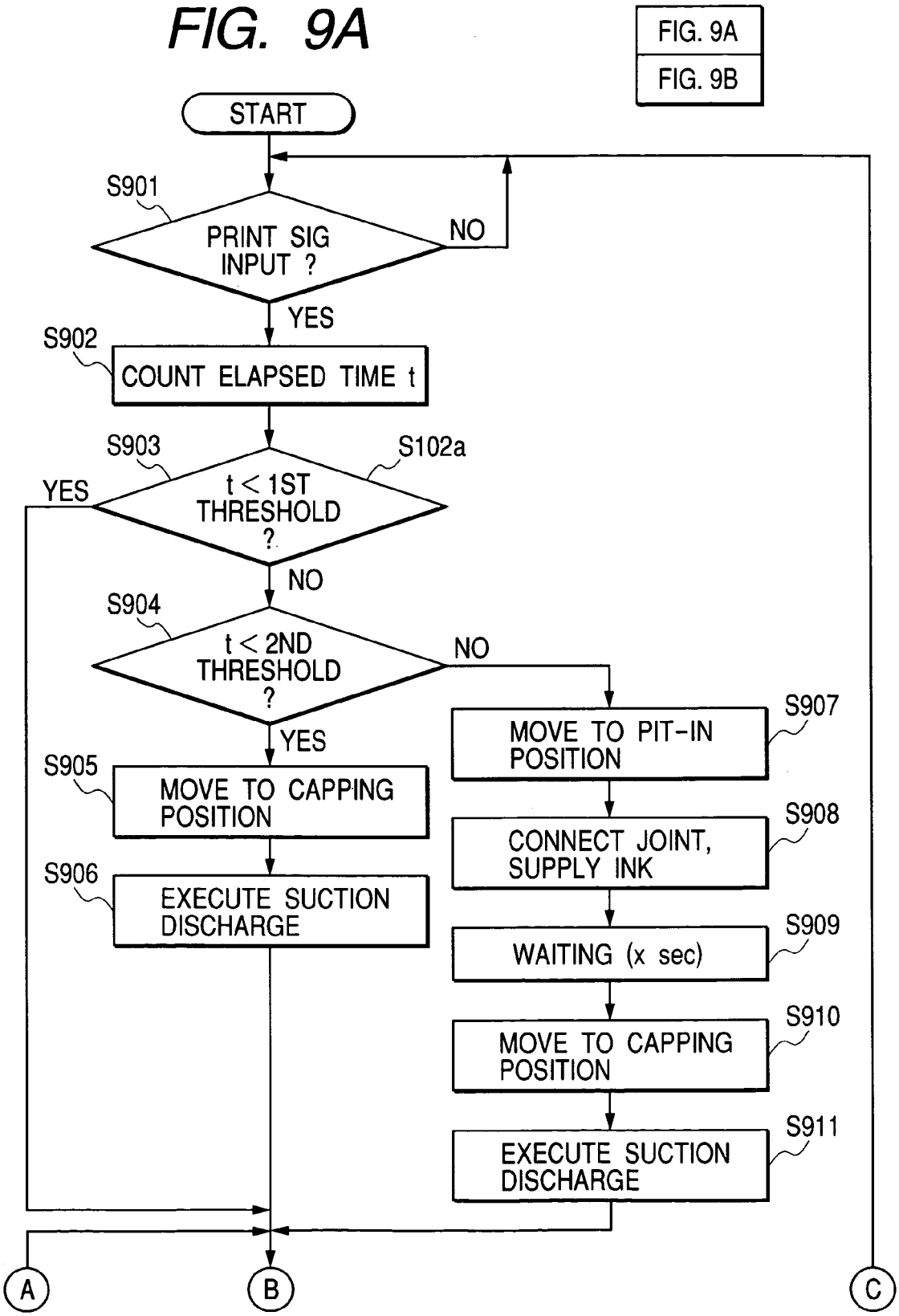
FIGS. 9A and 9B, combined as shown in FIG. 9, are flowcharts showing a printing operation of a first embodiment.
Figure 9B:
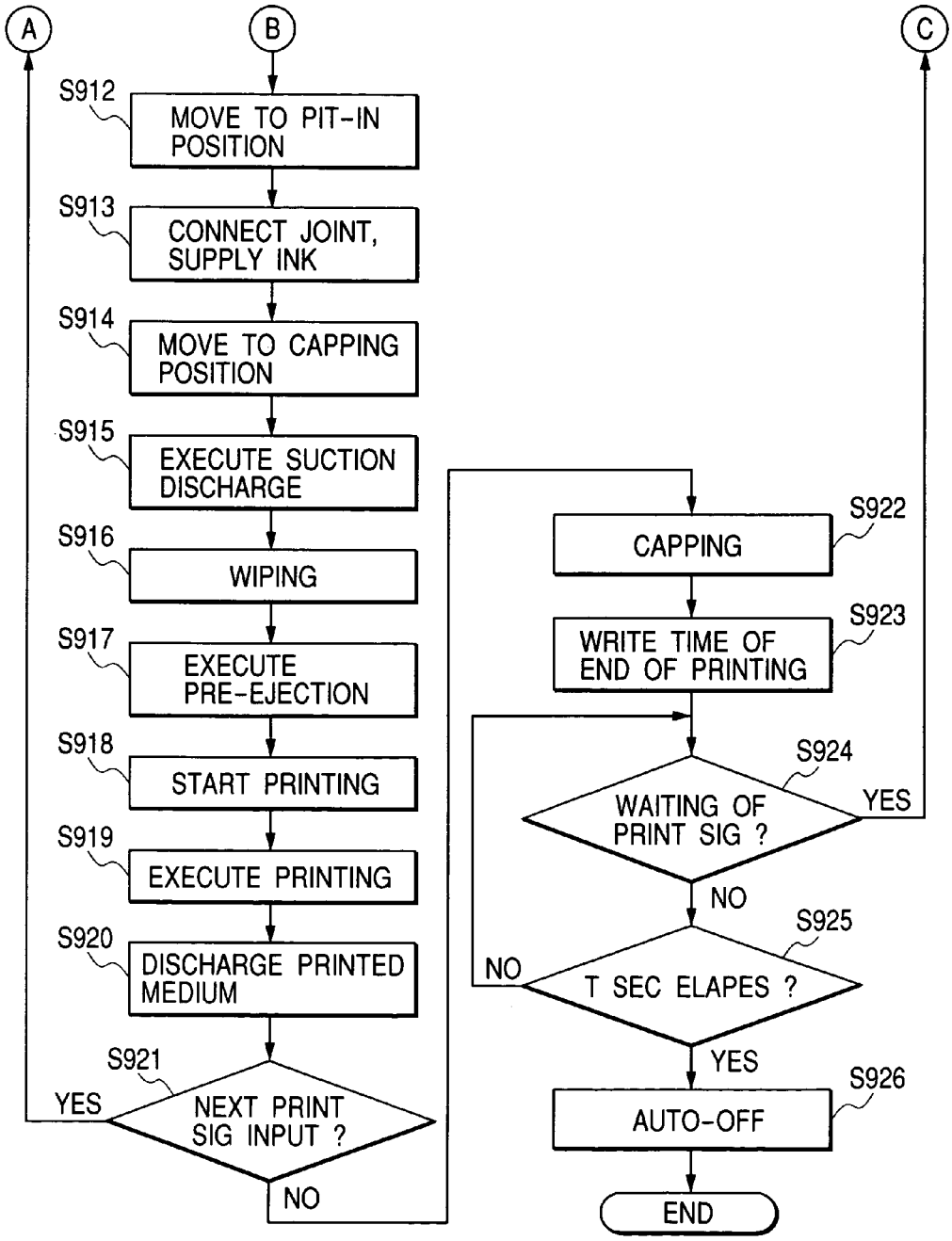

FIGS. 9A and 9B are sequential views showing a printing operation of the system.

First, upon an entry of a printing start signal, an elapsed time t from the end of the previous printing is measured (steps 901, 902). According to the method for measuring the elapsed time, the time is measured by the internal timer installed in the recording device. Incidentally, in the case of a recording device which comprises no internal timer, there is available a method for measuring the elapsed time by obtaining time information from an external connected device such as a PC or a digital camera which is connected at the time of a printing operation. Additionally, even if the elapsed time measured in step 902 may be an elapsed time from turning-OFF of power rather than that from the end of the previous printing, it is possible to measure an approximate time of leaving the ink in the subtank 530.

Next, the measured elapsed time t is compared with the first threshold value, the second threshold value (steps 902, 903). If the elapse time t is less than the first threshold value, a process from step 912 is carried out. If the elapsed time t is not less than the first threshold value and less than the second threshold value, a process from step 905 is carried out. Further, if the elapsed time t is not less than the second threshold value, a process from step 907 is carried out. Incidentally, according to the embodiment, the first threshold value is set to 10 days, and the second threshold value is set to 30 days. The elapsed time (days) which becomes such a threshold value is set based on results of an experiment of the amount of moisture evaporation in the ink tank and an actually printed image.

If the elapsed time t is less than the first threshold value, since ink concentration in the subtank 530 is within a range of permissible values, a general ink supplying method is selected to carry out a process of steps 912 to 917. Specifically, the recording head unit 500 is moved to a position in which the subtank 530 can be connected to the main tank 203 (may be referred to as a pin-in position), and a pit-in operation is carried out to supply an ink (steps 912, 913).

When the subtank 530 is filled up with the ink, the recording head 520 is moved to a position in which the recording head 520 can be capped (may be referred to as a capping position), and a capping operation is carried out to abut the cap 410 on the recording head 520 (step 914). The pump cylinder 415 is driven to carry out sucking and jetting for jetting the predetermined amount of an ink from the recording head 520 (step 915). The execution of this sucking and jetting operation enables removal of staying bubbles or a viscosity-increased ink from the recoding head 520. Next, a wiping operation is carried out by a wiper blade to wipe off the ink stuck to the surface in which the ink outlet 521 of the recording head 520 is formed, thereby removing an unnecessary ink (step 916). For the wiper blade, preferably, an elastic material is used, and it is advisable to use urethane rubber or HNBR. Next, an extra jetting operation of an image into the cap 410 is carried out in order to jet a viscosity-increased object or a mixed color ink from the ink outlet 521 when the wiping operation is executed (step 917). The number of times of jetting when the extra jetting operation is executed varies depending on a form of the recording head 520 or a nozzle length. According to the present invention, 4000 to 10000 times of jetting are carried out for each color at a driving frequency equal to that during the general printing, or a frequency lower than that during the general printing.

If the elapsed time t is not less than the first threshold value and less than the second threshold value, ink supplying is carried out after the ink is jetted from the subtank 530. Specifically, in order to execute a process of jetting the ink from the recording head 520, the recording head is moved to a position in which the recording head can be capped (may be referred to as a capping position) (step 905). In this case, if the recording head has been in the position in which the cap 410 can be abutted on the recording head 520, this operation is omitted. After the capping operation is carried out to abut the cap 410 on the recording head 520, a negative pressure is generated by the pump cylinder 415 connected to the cap 410, and a sucking and jetting operation is carried out to jet the residual ink from the subtank 530 (step 906).

Since viscosity of the ink in the subtank 530 is slightly increased during the jetting operation, preferably, the pump cylinder 415 is driven to apply a negative pressure in the subtank 530, and the subtank 530 is held in this state for a fixed time. According to the embodiment, an ink sucking and jetting operation is carried out by driving the pump cylinder 415 to apply a negative pressure of about −0.2 Mpa and holding this state for 5 seconds. The negative pressure and holding time are not fixed values and, preferably, a negative pressure and holding time which enable effective execution of ink sucking and jetting are changed depending on a hole diameter of the ink outlet 521 or an ink composition.

Ink supplying into the subtank 530 and printing preparations are carried out by executing the operations of steps 912 to 917 after the ink is jetted from the subtank 530.

If the elapsed time t is not less than the second threshold value, since the viscosity of the ink in the subtank 530 is increased, an ink is supplied to reduce ink concentration in the subtank 530, and then the ink is jetted. Subsequently, an ink is further supplied. Specifically, the recording head unit 500 is moved to the pin-in position, and a pin-in operation is carried out to supply an ink (steps 907, 908).

Next, the ink is held for a predetermined time in order to dilute the viscosity-increased ink in the subtank 530 (step 909). According to the embodiment, the holding time is about 1 to 10 seconds. However, the holding time varies depending on an ink component or a constitution of the ink tank, and it is set based on ink viscosity after moisture evaporation. After an elapse of a predetermined time from the ink supplying, the recording head unit is moved to the capping position to execute a capping operation, and a sucking and jetting operation is carried out to jet all the inks from the subtank 530 (step 911).

After the jetting of the ink from the subtank 530, the operations of steps 912 to 917 are carried out to supply an ink into the subtank 530 and to prepare for the printing.

After the printing has been prepared, a printing operation for printing an image based on received image data is started. When the printing operation on one print medium is finished, the print medium is jetted (steps 918 to 920). Next, determination is made as to whether a printing signal indicating an instruction to execute further printing has been entered or not. If the printing signal has been entered, the process returns to step 912, and a printing operation is carried out after an ink is supplied (step 921). If no printing signal has been entered, the recording head unit 500 is moved to the capping position to execute a capping operation, and a time of a printing end is written in the memory (steps 922, 923). In step 923, the time of the printing end is stored in the nonvolatile memory (NVRAM) of the recording device, whereby the elapsed time from the printing end is calculated by reckoning from the stored printing end time at the time of the next printing, and an optimal recovery operation can be carried out.

Next, the process waits for a predetermined time until a printing signal is entered. If a next printing signal is not entered even after an elapse of T seconds, the power of the recording device is turned OFF to finish the process (steps 924 to 926).

As described above, according to the embodiment, it is possible to suppress wasteful consumption of an ink by selecting/changing an ink supplying method before printing in accordance with the elapsed time from the end of the previous printing. Moreover, it is possible to always obtain stable printing quality image by suppressing the deterioration of the image caused by an ink concentration change which occurs because of the longer standing time.

In step 921 of the embodiment, if the next printing signal has been entered, the process returns to step 912 to supply the ink. However, in the case of a constitution in which the subtank 530 can contain an ink equivalent to two or more recorded media, the printing operation may be started without ink supplying. Additionally, in the recording device adapted to measure a volume of an ink contained in the subtank 530, in step 921, the printing operation may be started without ink supplying if the amount of an ink necessary for printing next image data is contained in the subtank 530, and ink supplying may be carried out if the amount of an ink necessary for the printing is not contained.

According to the embodiment, the printing end time is stored in the memory in order to measure the elapsed time from the end of the previous printing. However, a constitution may be employed in which a timer is installed in the recording device and, when the printing operation is finished, the timer is reset for driving. According to such a constitution, an elapsed time can be calculated only by obtaining a value of the timer without executing time calculation.

Furthermore, by installing a humidity sensor or a temperature sensor in the recording device of the embodiment, an evaporation level and viscosity of the ink in the subtank 530 can be accurately obtained in accordance with the elapsed time. Thus, it is possible to select a more proper ink supplying method.

SECOND EMBODIMENT

The embodiment will be described by way of how to select an ink supplying method in accordance with an elapsed time from the end of previous printing in a recording device which does not comprise a timer for time measurement or an internal battery. The recording device of the embodiment is similar to that of the first embodiment except for nondisposition of a timer or an internal battery, and thus description of the recording device will be omitted.

Generally, the recording device receives image data for printing from an external connected device, and carries out a printing operation based on the received image data. As the external connected device, there is a personal computer (may be referred to as PC or host computer). The personal computer comprises a clock function of always counting a time to update data in an ON state of a power plug. When the recording device obtains time information, a command may be transmitted from the recording device to the personal computer to cause the personal computer to send the time information. Alternatively, the personal computer may comprise a function of causing a printer driver installed therein to add the time information before the image data, and to issue a printing signal. An elapsed time is calculated based on the obtained time information and the time of the end of the previous printing stored in a memory, and an ink supplying method can be selected in accordance with the calculated elapsed time.

The ink supplying method selected in accordance with the calculated elapsed time is similar to that of the first embodiment. However, if the time information which the recording device obtains from the external device is before the end time of the previous printing, an ink supplying method when the elapsed time t is not less than a second threshold value is selected by determining that the time information obtained at the end time of the previous printing or the latest printing is mistaken. By selecting the ink supplying method when the elapsed time t is not less than the second threshold value, it is possible to obtain a stable image.

In the constitution of the embodiment for obtaining the time information from the external device, a time may be set in a state of a slight error depending on a device, and thus a correct elapsed time cannot be obtained sometimes. Therefore, by setting a threshold value not to a time unit (HOUR) but to a day unit (DAY), it is possible to absorb the slight error of time setting.

As described above, even in the constitution of no timer installed in the recording device, by obtaining the time information from the external connected device, the elapsed time from the end of the previous printing is obtained, a proper ink supplying method can be selected in accordance with the elapsed time, and a stable printing quality image can be obtained. Moreover, the selection of the ink supplying method in accordance with the elapsed time enables suppression of wasteful consumption of an ink during ink supplying.

Incidentally, in a constitution in which the personal computer is not used as the external connected device, but a digital camera or a video camera is directly connected to the recording device, time information may be obtained from the digital camera or the video camera.

THIRD EMBODIMENT

The embodiment will be described by way of example in which a digital camera and the recording device of the present invention are integrated.

Figure 10:
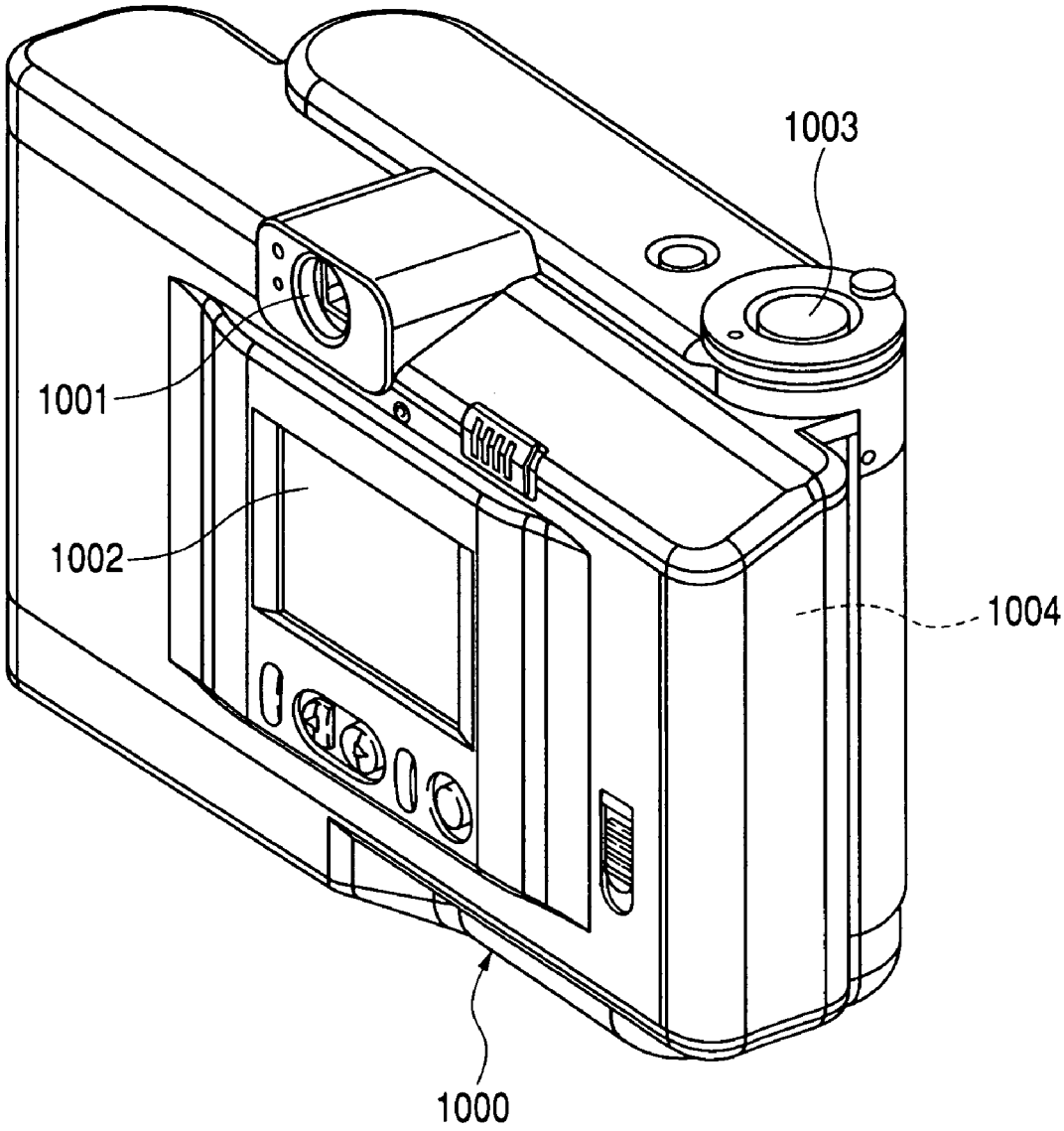
FIG. 10 is a perspective view of a printer-incorporated camera to which the present invention can be applied.
Figure 11:
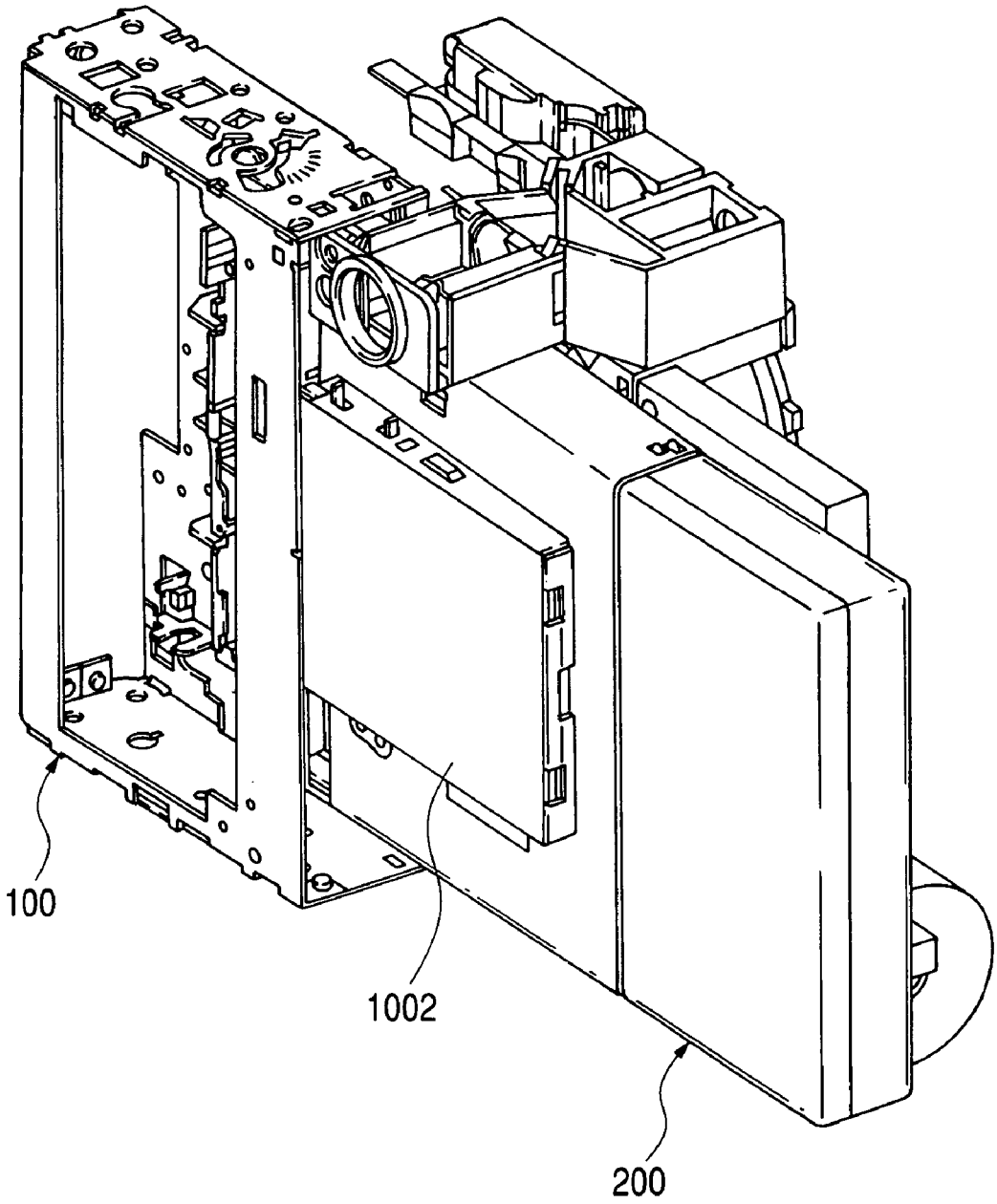
FIG. 11 is a perspective view of the printer-incorporated camera to which the present invention can be applied.
Figure 12:
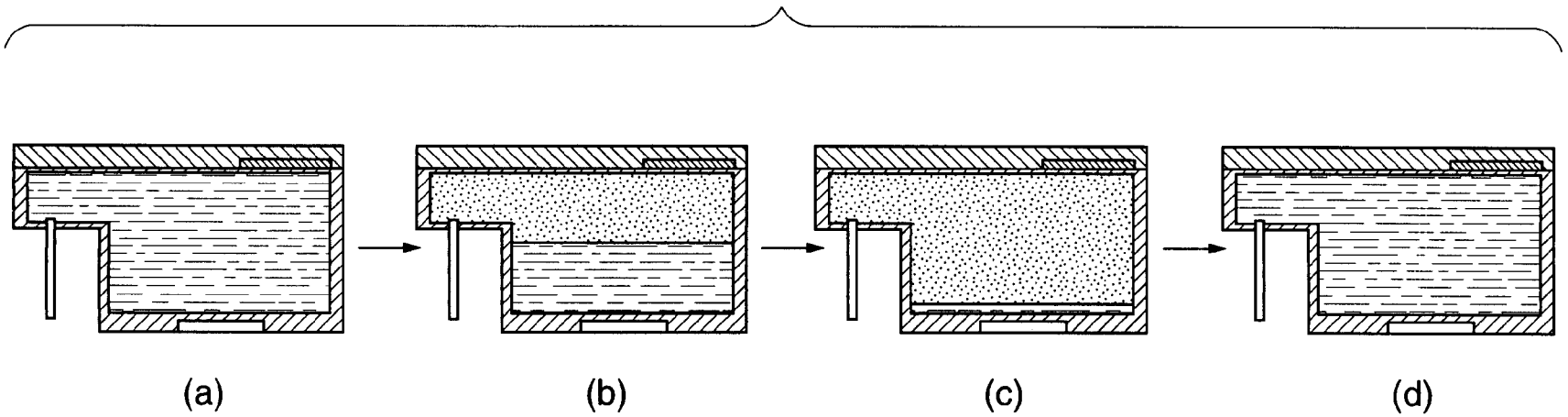
FIG. 12 is a conceptual diagram time-sequentially showing a relation of the amount of a residual ink in a subtank.

FIGS. 10 and 11 are perspective views of a camera equipped with a printer of the embodiment.

In FIG. 10, a reference numeral 1000 is a camera equipped with a printer, and a reference numeral 1003 is a shutter button of the digital camera. A reference numeral 1001 is a finder used during photographing by the digital camera. A reference numeral 1002 is a liquid crystal used for various kinds of setting of the digital camera or the recording device during photographing, during displaying of taken photos, or during photo printing. A reference numeral 1004 is an insertion port of a media pack.

By integrating the digital camera with the recording device, a photo taken by the digital camera can be quickly printed. Since the recording device of the embodiment is integrated with the digital camera which is frequently used outdoors, the amount of moisture evaporation in the subtank 530 is expectedly greater compared with the situations of the first and second embodiments. Thus, the ink outlet 521 of the recording head 520 is dried to easily increase viscosity of an ink. Therefore, according to the embodiment, by setting first, second threshold values smaller than those of a recording device which is used indoors, a stable printing quality image is obtained even when the recording device is used outdoors.

As described above, if the recording device of the present invention is used, the size of the recording device itself can be reduced. Accordingly, the recording device can be integrated with other products such as a digital camera, and images can be formed in various situations. Moreover, even if the recording device is integrated with the other product, by selecting the ink supplying method in accordance with the elapsed time from the end of the previous printing, it is possible to always obtain a stable printing quality image.

What is claimed is:

1. An ink jet recording device which has a first ink tank for storing an ink, a second ink tank capable of being separated from/connected to the first ink tank through an ink supply path, and a recording head for jetting an ink supplied from the second ink tank, and which carries out recording by jetting an ink from the recording head to a recording medium, the ink jet recording device comprising:

measuring means for measuring an elapsed time from an end of the previous recording; and supplying means for supplying an ink from the first ink tank to the second ink tank, wherein the supplying means supplies the ink from the first ink tank to the second ink tank if the elapsed time measured by the measuring means is less than a first threshold value; otherwise supplies the ink from the first ink tank to the second ink tank after a residual ink is jetted from the second ink tank, if the elapsed time is not less than the first threshold value and less than a second threshold value; and otherwise supplies the ink from the first ink tank to the second ink tank, and jets the ink from the second ink tank to supply the ink again, if the elapsed time is not less than the second threshold value.

2. The ink jet recording device according to claim 1, wherein if the elapsed time is not less than the second threshold value, the ink supplying means supplies the ink from the first ink tank to the second ink tank, and jets the ink from the second ink tank after an elapse of a predetermined time.

3. The ink jet recording device according to claim 2, wherein the predetermined time is 3 seconds or more.

4. The ink jet recording device according to claim 1, wherein the supplying of the ink by the ink supplying means is carried out before a start of recording.

5. The ink jet recording device according to claim 1, further comprising: a pump for generating a negative pressure in the second ink tank, wherein the pump is driven when the ink is supplied from the first ink tank to the second ink tank, or when the ink is jetted from the second ink tank.

6. The ink jet recording device according to claim 1, further comprising: a timer operated by a battery, wherein the measuring means measures the elapsed time based on time information obtained from the timer.

7. The ink jet recording device according to claim 1, wherein the measuring means obtains time information from a timer which a device connected to the outside of the recording device has, and measures the elapsed time based on the time information.

8. An ink supplying method in an ink jet recording device which has a first ink tank for storing an ink, a second ink tank capable of being separated from/connected to the first ink tank through an ink supply path, and a recording head for jetting an ink supplied from the second ink tank, and which carries out recording by jetting an ink from the recording head to a recording medium, the ink supplying method comprising:

a measuring step of measuring an elapsed time from an end of previous recording;

a comparing step of comparing the elapsed time measured in the measuring step with a first threshold value or a second threshold value; and a supplying step of supplying an ink from the first ink tank to the second ink tank in accordance with a result of the comparison in the comparing step, wherein in the supplying step, the ink is supplied from the first ink tank to the second ink tank if the elapsed time is less than the first threshold value; otherwise the ink is supplied from the first ink tank to the second ink tank after a residual ink is jetted from the second ink tank, if the elapsed time is not less than the first threshold value and it is less than the second threshold value; and otherwise the ink is supplied from the first ink tank to the second ink tank, and the ink is jetted from the second ink tank to supply the ink again, if the elapsed time is not less than the second threshold value.

9. The ink supplying method according to claim 8, wherein in the ink supplying step, if the elapsed time is not less than the second threshold value, the ink is supplied from the first ink tank to the second ink tank, and the ink is jetted from the second ink tank after an elapse of a predetermined time.

* * * * *